US011339990B2

(12) United States Patent
Larsson

(10) Patent No.: US 11,339,990 B2
(45) Date of Patent: May 24, 2022

(54) AIR TERMINAL DEVICE FOR CONTROL OF AIR FLOW IN A VENTILATION SYSTEM

(71) Applicant: Swegon Operations AB, Kvänum (SE)

(72) Inventor: Per Åke Larsson, Västra Åmtervik (SE)

(73) Assignee: SWEGON OPERATIONS AB, Kvanum (SE)

( * ) Notice: Subject to any disclaimer, the term of this patent is extended or adjusted under 35 U.S.C. 154(b) by 309 days.

(21) Appl. No.: 16/379,223

(22) Filed: Apr. 9, 2019

(65) Prior Publication Data

US 2019/0309980 A1 Oct. 10, 2019

(30) Foreign Application Priority Data

Apr. 9, 2018 (SE) ..... 1830118-4

(51) Int. Cl.

| | |
|---|---|
| ***F24F 11/72*** | (2018.01) |
| ***F24F 1/0014*** | (2019.01) |
| ***F24F 13/10*** | (2006.01) |
| ***F24F 1/0035*** | (2019.01) |
| ***F24F 1/0063*** | (2019.01) |

(Continued)

(52) U.S. Cl.

CPC ..... *F24F 11/72* (2018.01); *F24F 1/0011* (2013.01); *F24F 1/0014* (2013.01); *F24F 1/0035* (2019.02); *F24F 1/0063* (2019.02); *F24F 1/01* (2013.01); *F24F 13/06* (2013.01); *F24F 13/10* (2013.01); *F24F 13/12* (2013.01);

(Continued)

(58) Field of Classification Search

CPC ..... F24F 11/72; F24F 1/0011; F24F 1/0035; F24F 1/0063; F24F 1/01; F24F 13/06; F24F 13/12; F24F 13/26; F24F 1/0014; F24F 13/10; F24F 2013/0616; F24F 13/0236; F24F 1/00

USPC ..... 454/358

See application file for complete search history.

(56) References Cited

U.S. PATENT DOCUMENTS

| | | | | |
|---|---|---|---|---|
| 2009/0098820 | A1* | 4/2009 | Yabu | F24F 1/0047 454/333 |
| 2009/0277204 | A1 | 11/2009 | Heuer et al. | |
| 2015/0247648 | A1* | 9/2015 | Soderberg | F24F 11/74 454/334 |

FOREIGN PATENT DOCUMENTS

| | | |
|---|---|---|
| CH | 57712 | 2/1913 |
| DE | 7924975 U1 | 6/1978 |
| EP | 1918650 A2 | 5/2008 |
| GB | 191214128 | 1/1913 |

(Continued)

OTHER PUBLICATIONS

Swedish Search Report, 1830118-4 dated Apr. 9, 2018.

(Continued)

*Primary Examiner* — Jessica Yuen

(74) *Attorney, Agent, or Firm* — Nixon & Vanderhye

(57) ABSTRACT

An air terminal device for a ventilation system includes a pressure box, with an inlet admitting supply air into the pressure box and outlet openings for admitting supply air out. The air terminal device further includes a cover plate to control and change the open area of the outlet openings. The outlet openings are in a wall of the pressure box forming an outlet surface of the pressure box. The cover plates are arranged to make contact with and slide relative the outlet surface while changing the open area of the outlet openings. The cover plate is located on the high pressure side of the outlet surface. The cover plate cooperates with the outlet surface such that there is at least one outlet opening or suction opening being partly or fully covered by the cover plate also when the air terminal device is set to maximum flow.

19 Claims, 5 Drawing Sheets

(51) Int. Cl.

| | |
|---|---|
| ***F24F 1/01*** | (2011.01) |
| ***F24F 13/06*** | (2006.01) |
| ***F24F 13/12*** | (2006.01) |
| ***F24F 13/26*** | (2006.01) |
| ***F24F 1/0011*** | (2019.01) |
| ***F24F 13/02*** | (2006.01) |

(52) U.S. Cl.
CPC ..... *F24F 13/26* (2013.01); *F24F 13/0236* (2013.01); *F24F 2013/0616* (2013.01)

(56) References Cited

FOREIGN PATENT DOCUMENTS

| | | | |
|---|---|---|---|
| JP | 57191352 | | 12/1982 |
| JP | H05-32943 | U | 4/1993 |
| JP | H10-54606 | A | 2/1998 |
| JP | 2003-014285 | | 1/2003 |
| JP | 3516787 | B2 | 4/2004 |
| SE | 517 998 | | 8/2002 |
| SE | 1450434 | A1 | 10/2015 |
| SE | 540427 | C2 | 9/2018 |
| WO | WO 2017/048173 | | 3/2017 |

OTHER PUBLICATIONS

Extended European Search Report issued in European Patent Application No. 19168134.5 dated Aug. 27, 2019.
Extended European Search Report issued in European Patent Application No. 19168140.2 dated Aug. 19, 2019.

* cited by examiner

AIR TERMINAL DEVICE FOR CONTROL OF AIR FLOW IN A VENTILATION SYSTEM

TECHNICAL FIELD

The present invention relates to an air terminal device for a ventilation system for a building, e.g. a Heating and Ventilating Air Conditioning (HVAC) system. The air terminal may be an air diffuser or an induction unit, with or without temperature regulating means. However, the invention is in particular suitable for induction units provided with a temperature regulating device.

BACKGROUND ART

Centralized air ventilation systems such as Heating and Air Conditioning (HVAC) systems are generally provided in all premises or larger buildings constructed today. In order to provide for desired ventilation, and generally also conditioning the air to a relevant temperature, there is a desire to control the ventilation system to provide a relevant amount of air and condition the air to be at the right temperature. A common way of controlling the supply air and conditioning the air is to use cooling beams in induction units. The cooling beam may be set to provide a desired flow of supply air by controlling the open area of the outlet openings for fresh air whereby a fresh air flow may be calculated from a known pressure difference between the different sides of the outlet openings. In an induction unit, the flow of fresh air will withdraw room air, i.e. induce an air flow, to be mixed in a mixing chamber. In general, the cooling beam is thus construed such that the induced air flow will pass a temperature regulating battery and thus heat or cool the induced air flow. Even though this kind of arrangement is commonly referred to as a cooling beam it may be used for heating or cooling of the induced air flow. These kind of air terminal units, cooling beams, may also be referred to as chilled beams, temperature regulated induction units, comfort cassettes and are commonly shaped to be quadratic or rectangular having outlets along two or all four sides.

As there is an increasing interest in providing more energy efficient ventilation systems, the ability to control the air flow in each room according to the demand, e.g. amount of fresh air and temperature, is desired to avoid unnecessary ventilation or heating. Hence, there is generally a desire to provide an air terminal device which may be automatically controlled to deliver the desired amount of air and provide a desired heating/cooling operation by regulating the air terminal device. Such devices are previously known and may for example be found in SE 517 998, which discloses a device which provide a flow in two directions, or in WO 2017/048 173 which provide a flow in four directions. These devices should thus be suitable to be used as air terminal devices in a Variable Air Volume (VAV) system wherein a variable volume of air to be ventilated to a room is controlled at the air terminal device.

In order to be able to control the air volume to correspond to the desired fresh air volume flow, and also an induced air flow if it is an induction unit, there is a desire to control the open area of the outlet openings with a desired accuracy. To precisely control the open area is in general more difficult for a terminal unit which blows in four directions, as disclosed in WO 2017/048173, than in an air terminal unit which blows only in 2 directions as disclosed in SE 517 998. As can be seen in WO 2017/048 173 the device is provided with outlet openings along all four edges. However, there is a need for rather exact tolerances and correct mounting of the cover plate in order to control the open area of the outlet openings in all directions.

Hence, there is a desire for an improved air terminal device which may better control the air flow, in particular for a terminal device having outlet openings for providing a ventilation flow in a multitude of directions.

SUMMARY OF THE INVENTION

The invention is directed to an air terminal device and a method for controlling such an air terminal device in order to regulate the air flow in a ventilation system, e.g. a Heating and Ventilation Air Conditioning (HVAC) system, in a building. The air terminal device is designed to control the air flow into a room or premise. In general, the air terminal device is located in the room. By air terminal device is intended to include all kind of devices designed to control an airflow into a room such as air diffusers which mainly function as a device which only is intended to control the air flow quantity, and possibly also the direction, of the air admitted to a room where it is mounted; induction devices which are designed to cause air from the room to be withdrawn by the supply air so as to form a mixed air stream of supply air and room air; and temperature regulating devices such as cooling beams, which may be designed as induction units, having a temperature regulating battery for cooling or heating of an air flow, e.g. the induced air flow or mixed air flow in an induction unit. Hence, the present invention may be used in any of these air terminal devices even though it is particularly suitable to be used in cooling beams and may be used to set the supply air flow to a desired level to provide a supply airflow causing a desired induction air stream of room air. The air terminal device is designed to provide control also for induction devices designed to provide airflows in a multitude of directions, e.g. for a rectangular or square shaped device having outlets along two sides, along all its four sides and providing air streams in four main directions or all along a circular edge of a round device. The air terminal device comprises a pressure box.

The pressure box may have essentially any shape and may vary in size. Hence, a pressure box is a space in which supply air above atmospheric pressure is contained. The pressure box is provided with at least one inlet for admitting supply air into the pressure box. The supply air may be provided from a central Air Handling Unit (AHU) delivering the supply air via a ventilation ducting system to the pressure box or from any suitable source. The pressure box is further provided with a plurality of outlet openings for admitting supply air out of the pressure box. The plurality of outlet openings is arranged in a wall of the pressure box forming an outlet surface of the pressure box. The outlet openings may differ in size and shape. They may for example be designed as elongated slots such that the open area of the openings may be adjusted step less to a desired size or having openings, e.g. circular shaped, with different areas intended to be completely open or closed such that different flows may be achieved by changing which openings that are open. In order to change the air flow through the air terminal device, the air terminal device further comprises at least one cover plate. The cover plate is arranged to control and change the open area of a plurality of the outlet openings by being arranged to be in contact with and slide relative the outlet surface while changing the open area of the outlet openings, either by changing the open area of outlet openings or by changing the number and/or size of outlet openings being in open position or a combination thereof.

The air terminal device is further designed such that the at least one cover plate is located on the high pressure side of the outlet surface. By placing the at least one cover plate on the high pressure side will the pressure difference over the outlet surface contribute with a suction force in order to aid in forcing the at least one cover plate towards the outlet surface and contribute to force the cover plate to lie tight against the outlet surface. In order to further improve the air terminal device and provide for a close and tight fit between the outlet surface and the at least one cover plate, the cover plate and the outlet surface are designed such that there is at least one outlet opening or a suction opening being partly or fully covered by said cover plate also when the air terminal device is set to maximum flow. By suction opening is meant an opening in the outlet surface which main purpose is to be covered by the at least one cover plate in order to provide a suction force over the outlet surface forcing the at least one cover plate towards the outlet surface. Hence, the air terminal device is preferably designed such that the at least one cover plate also in its fully open position has at least one outlet opening or suction opening being partly or fully covered by the at least one cover plate in order to force the cover plate towards the outlet surface by the pressure difference between the pressure box and the surroundings. The maximum flow may either be a physical limit preventing the cover plate to move further in a direction or a limit set in an ECU.

According to a first embodiment, the air terminal device may be designed such that one or several of the outlet openings have a larger area than the majority of the outlet openings. The outlet surface comprising the outlet openings and at least one cover plate may thus be designed to cooperate such that a portion of the outlet openings having a larger area are only partially covered when the air terminal device is set to maximum flow. For example, the outlet openings may be in the shape of elongated slots whereof some of the slots are longer than the majority of the slots such that the longer slots will be covered by the at least one cover plate also when the air terminal device is set to maximum flow. For instance, the enlarged outlet openings may be designed to have at least 20% of their area covered also when the air terminal device is set to maximum flow.

According to a second embodiment, which may be used instead of or combined with the first embodiment, the air terminal device is designed to include one or several suction openings in the outlet surface. The suction openings are designed to cooperate with said at least one cover plate such that said suction openings are fully covered when the air terminal device is set to maximum flow. The suction openings may be located anywhere in order to provide a suction force in order to force the at least one cover plate towards the outlet surface. In general, the suction openings are desired to be located adjacent to the outlet openings in order to provide the suction force to cause the at least one cover plate to be forced tight against the outlet surface close to the outlet openings in order to reduce noise arising from the cover plate not being sufficiently tight against the outlet surface. The suction openings could be designed to cooperate with the at least one cover plate such that the suction openings are always completely covered by said cover plate.

The cover plate to be used in the air terminal device is preferably made from a thin sheet material. The cover plate is therefore relatively thin and may have a thickness that falls below 2.0 mm, preferably below 1.0 mm and most preferably even below 0.6. The desired thickness of the cover plate is of course dependent of the material it is made of.

The cover plate could suitably be made from a polymer, e.g. a polymer sheet. The polymer sheet to be used could have a thickness of 0.05 to 2.0 mm, more preferably between 0.10 and 1.0 mm and most preferably 0.1 to 0.6 mm.

The sheet material forming the cover plate shall preferably be selected such that the cover plate is sufficiently stiff and able to slide easily against the vent surface without folding or being wrinkled. The material chosen for the plate can therefore be a polyester film, for example Mylar® A which for example may be used in a thickness from 0.15 to 0.50 mm. The material that is used suitably has a Young's modulus that exceeds 1500 MPa according to the test method ASTM D 882 since too soft materials have a tendency to fold. In general, a sheet material having a Young's modulus of 1 000 to 20 000 MPa, preferably of 1 500 to 15 000 MPa and most preferably between 2 000 and 10 000 MPa are suitably used.

The above parameters are intended to guide the skilled person to find a relevant choice of material. However, the cover plate may be provided with reinforcements in order to provide rigidity to a sheet material in the lower range or even outside the suggested ranges while surface modifications or weakened portions may be provided to a sheet material having a Young's modulus in the upper ranges or even above to make the cover plates contact surface smoothly follow the outlet surface and cause the cover plate to be tight against the outlet surface. Hence, the cover plate shall have a sufficient rigidity and stiffness in relation to the friction that arises when the cover plate is pushed such that the cover plate does not fold, wrinkle or bend while at the same time being flexible in order to follow tight against the outlet. The cover plate, with its recessed apertures, thus has to present a sufficient bending rigidity. The bending rigidity partly depends on material and thickness, but also on the aperture configuration. It is also important that the surface does not stick, i.e. the properties of the cover plate material shall not be of such character that it has a too large tendency to stick at the surface. The surface property of the material thus becomes a matter of finding a material for the cover plate that follows sufficiently tightly against the outlet surface at the same time as the cover plate does not stick too hard to the surface.

According to one aspect of the invention, the cover plates are made of a thin, flexible sheet. The cover plate could for example be made of polymer material. The use of such a material has a number of advantages such as reducing weight, improving the ability to follow the outlet surface thus form a tight seal between the outlet surface and the cover plate due to the flexibility of the material and also making the cover plates to slide with less power needed when changing their positions. The cover plate could for example be made from a sheet material having a thickness of 0.15 to 0.60 mm. The cover plate is preferably made from a sheet material having a surface weight of less than 1 kg per square meter, more preferably of less than 0.5 kg per square meter. The weight of the cover plate may in particular be of interest if the cover plate is located in the air terminal device such that the gravity is striving to separate the cover plate from the outlet surface. Cover plates most commonly used today in similar devices are generally made from sheet metal having a considerably higher weight per square metre, about 5 to 10 times higher, than for a polymer sheet having the same thickness. Using metal as a cover plate material may thus render the sheet considerably heavier or being very thin rendering the sheet to be vulnerable to be wrinkled and/or to not be as flexible as desired. The use of polymer will thus enable in an easier way to provide cover plates having a low surface weight while being elastically deformed to follow the outlet surface.

The cover plate or cover plates may be used in different kinds of air terminal devices, e.g. in a rectangular cooling beam having outlet openings along two opposite sides and a cover plate for each side or having a four way outflow in four directions from a square shaped device having one or several cover plates for controlling the open area of the outlet openings and/ or the number sizes of the open outlet openings.

The air terminal device may be designed to comprise at least two cover plates, a first cover plate and a second cover plate. By including at least two cover plates it will be possible to provide covering surfaces moving in different directions over the same outlet surface. This enables a more uniform control of a uniform flow pattern in different directions, e.g. when it is desired to provide an air flow from all sides in a rectangular or square shaped device. The first cover plate and the second cover plate are thus arranged to be in contact with the outlet surface in order to readily cover and close the outlet openings, either partly or completely. The cover plates may further be arranged to overlap each other and to slide relative each other and the outlet surface. The cover plates may thus move in different directions while changing the open area of the outlet openings and thus cause an essentially uniform motion for openings along different sides or direction of the outlet surface.

According to one aspect of the invention the plurality of outlet openings are arranged along one or several edges of the outlet surface. The plurality of outlet openings could for example be arranged on an outlet surface having at least four edges, e.g. a quadratic or rectangular surface, and the design of the outlet openings could be designed such that there are provided outlet openings along two edges, most preferably opposite edges, or all four edges. In general, when two cover plates are used, the air terminal device is designed such that the first cover plate is arranged to control a first group of outlet openings and the second cover plate is arranged to control a second group of outlet openings such that all the outlet openings are controlled by the first and second cover plates. In the case of a square shaped or rectangular outlet surface, the first cover plate could be arranged to change the area of the outlet openings for outlet openings along a first edge and a second edge being adjacent to each other. Hence, the first plate will provide for changing the air flow along a first and second side of the air terminal device. The second cover plate may thus be arranged to change the area of the outlet openings for openings along a third edge and a fourth edge being adjacent to each other. Even though rectangular or square shaped devices is most common, the arrangement function perfectly also for other shapes such as polygons, round or elliptical for example.

In general, when there are provided outlet openings arranged along one or several edges of the outlet surface it is an advantage to change the open area of the outlet openings to be smaller by moving the cover plates towards the edge or edges at which the outlet openings are located close to. As will be better explained below, and also in the detailed description of the drawings, may it be advantageous to cause the cover plates to move by a nonlinear motion, e.g. having a rotational motion, since this may allow the cover plates to move in different directions in an easy way.

As briefly discussed above, the outlet openings may be of different sizes and shapes. However, an advantageous shape of said plurality of outlet openings is to be shaped as elongated slits. By using slits, the distance between the edges of the opening may be rather small which may be beneficial from the view of avoiding annoying noise from the air terminal device due to the air flow while its elongated shape provide for an accurate step less increase and decrease of the open area of the outlet opening while the cover plates moves so as to cover the elongated opening from one end to the other. As will be explained in the detailed description of the drawings, by selecting the rotational motion of the cover plates in an adequate way, and using a cover plate being solid, i.e. no perforations, in the portion moving over the outlet openings, the cover plate as a whole may move relative the outlet openings such that the openings will be covered or uncovered from one end to another and the covering motion of the elongated slots will remind of a linear motion even though the cover plate moves in a non-linear, circular motion. The cover plates could of course also be moved linearly to achieve the same result. However, the use of a circular motion of the cover plates provides for a more efficient actuator arrangement even though the skilled person would understand that the use of a linear actuator also is within the scope of the inventive idea.

According to one aspect of the invention, the outlet openings are thus arranged according to a configuration which is changeable by that the at least two cover plates are arranged to change the configuration at all outlet openings simultaneously by moving the cover plates in different directions.

According to one aspect of the invention are the elongated slits arranged such that their longitudinal extension direction is angled less than 30 degrees relative its closest edge In general, the slits are arranged such that their longitudinal extension direction is essentially perpendicular to the extension direction of the closest edge.

In case it should be of interest to have a more uniform and proportional motion of the cover plate relative the slits, this could be achieved by an elliptical orbit reminding of a linear motion of the orbital motion of the cover plates. However, regardless of the shape of the outlet openings may the first and second cover plates be arranged to move non-linearly, e.g. by a circular or orbital motion, when sliding in order to change the area of the outlet openings.

In order to provide for this rotational or orbital motion, the first and second cover plates may be moved by a rotating actuator. According to one aspect of the invention is the rotating actuator connected to a pivotal point on the outlet surface. Attached to the pivotal point is a first actuating rod, preferably at its midpoint, and at its first end attached to the first cover plate and at its second end attached to the second cover plate. By this arrangement will there thus be a rotational force applied to each one of the cover plates. However, the use of one single actuator, attached to a single point on each cover sheet, may not be sufficient to provide a controlled motion of the cover sheets. In order to provide for a desired controlled motion there is a need for some other guiding means. A rather easy way to provide a controlled motion is to provide the arrangement with a second actuating rod which also is attached to the outlet surface, the first cover plate and the second cover plate in a similar way as the first actuating rod and thus functioning as "slave" and mimicking and following the motion of the first actuating rod. Hence, the second actuator rod need not to be connected to the rotational actuator but will follow the motion of the first actuator due to its attachment to the cover plates and the outlet surface such that the second actuating rod will be working in the same way as the first actuating rod. In case the cover plates are rather thin and flexible it may be desired to connect the ends of the actuating rods located on the same cover plates with a reinforcement between them such that it is assured that the second actuating rod, which function as a slave actuating rod, follows the first actuating rod functioning as a master actuator. It shall be noted that there may be alternative solutions to the use of a second actuating rod for guiding the motion of the cover plates, e.g. could there be some kind of guiding pin attached to the outlet surface and fitted to a slot in the cover plates to assure a proper movement of the cover plates.

As discussed above, the arrangement described herein may be used for a number of different air terminal devices. A device suitable for the arrangement is an induction unit provided with a temperature regulating battery, e.g. a heat exchange arrangement wherein the air to be temperature conditioned is exchanging heat with a liquid heat exchanger alternatively arranged to cool or heat a through-flowing air stream. The outlet openings could thus be directed to a mixing chamber such that a stream of air from the room to be ventilated is induced by the flow of the supply air through the outlet openings and a stream of supply air is mixed with room air. A common arrangement is to arrange the temperature regulating battery such that an induced circulation of air flow from the surroundings is guided to pass through the temperature regulating battery so as to be heated or cooled. The one or several mixing chambers is arranged to mix the supply air flow and the conditioned circulated air flow to a common air stream. The common air stream is guided further to one or several outlet openings in order to flow to the room to be ventilated In a rectangular or square shaped arrangement, wherein the outlet openings form different groups of outlet openings at each side of the pressure box, could the respective group of outlet openings, one group at each side, be arranged to direct the supply air to a respective mixing chamber for directing the mixed air flow in different directions. By using the control arrangement described herein in this case it may be possible to change the configuration at all outlet openings simultaneously by moving the cover plates in different directions. Hence, supply air and the mixed air flow from the air terminal device is changeable in all directions by the same actuator causing the two cover plates to move simultaneously.

By using thin, flexible sheet material it may easier be possible to allow the cover plates to overlap each other since the total thickness will be rather thin even though if they overlap and the flexibility of the material together with using thin sheets will make it possible to allow the cover plate to be tight against the outlet surface in the vicinity of the outlet openings and have a close fit between the outlet surface and the cover sheet even if the cover sheets overlap at some areas. Such arrangement would most certainly not have been possible to provide with such tight contact between the cover plates and the outlet openings with metal sheet plate material.

Hence, the flexibility and tightness of the cover plates renders the present device suitable to be used for any kind of air terminal device. It may in particular be used in VAV system due to the tightness of the seal between the outlet surface and the cover plate. Generally, there has been a desire to have an additional valve in the ventilation duct due to leakage in the air terminal device, e.g. a cooling beam, but this may be avoided with this arrangement.

The arrangement described herein may be used and controlled according to any known method and due to its low leakage a rather exact flow may be set using known methods, e.g. to calculate a flow of supply air based on pressure measurements and K-factors for a known position of the actuator or the direct measurement of the position of the cover plates relative the outlet surface using a look up table or algorithms for estimating or calculating a flow of fresh or recirculated air from the air terminal device.

In the above, the invention has been exemplified specifically for air terminal devices having elongated openings located at or in the vicinity of the edges of the outlet surface. However, the basic principle on which the present invention relies is applicable to essentially any kind of air terminal device using the principle of moving a cover plate over a wall provided with holes or opening in order to allow the a flow of air from a pressure box. The use of thin and flexible cover sheets, preferably made of a suitable polymer which may adapt to the surface of the openings in the wall of a pressure box, herein referred to as outlet surface, will in spite of the general knowledge, teaching of using sheet metal for this purpose, contribute to provide an air terminal device with a cover plate being able to be forced tight against the outlet surface and thereby improving the performance and accuracy of the control of air flowing through the outlet surface in the pressure box wall as well as reducing annoying noise.

DETAILED DESCRIPTION OF THE DRAWINGS

Figure 1A:
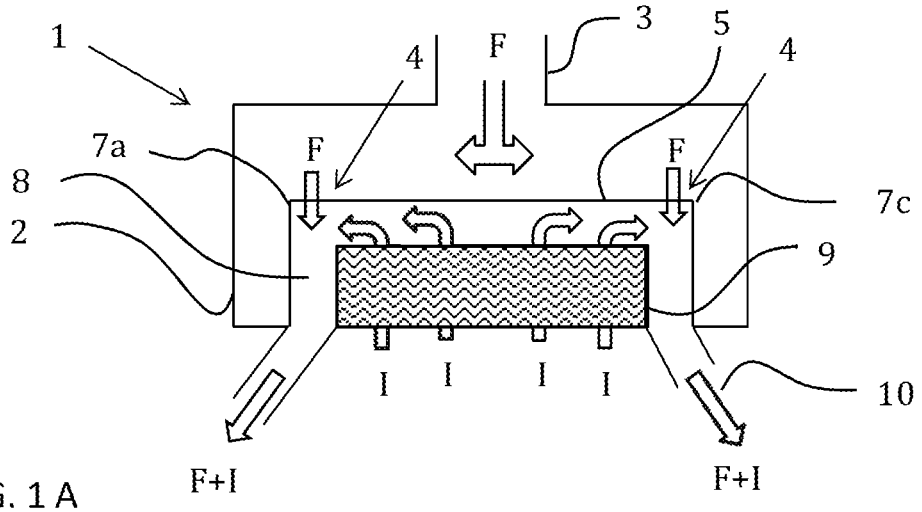
FIG. 1A discloses an air terminal device designed as an induction unit comprising an air temperature conditioner FIG. 1B discloses an air terminal device designed as an induction unit without temperature conditioning FIG. 1C discloses an air terminal device designed as an air diffuser without air temperature conditioner or induction arrangement FIG. 2A discloses an outlet surface provided with ordinary outlet openings having the same length FIG. 2B discloses an outlet surface provided with a mix of ordinary outlet openings and longer outlet openings FIG. 3A discloses an outlet surface as in FIG. 2A provided with cover plates when the cover plates are controlled to be in an open position FIG. 3B discloses an outlet surface as in FIG. 2A provided with cover plates when the cover plates are controlled to be in a covering position FIG. 4A discloses a circular outlet surface provided with cover plates when the cover plates are controlled to be in an open position FIG. 4B discloses a circular outlet surface provided with cover plates when the cover plates are controlled to be in a closed position FIG. 5A discloses an outlet surface having elongated slots alternating its longitudinal extension to be aligned with or perpendicular to the linear motion of the cover plate when the cover plate is in an open position FIG. 5B discloses an outlet surface having elongated slots alternating its longitudinal extension to be aligned with or perpendicular to the linear motion of the cover plate when the cover plate is in a closed position

In FIG. 1A is disclosed an air terminal device 1 for delivering air to a space to be ventilated. The air terminal device 1 comprises a pressure box 2 connected to a supply air inlet 3 through which an air stream of supply air (F) enters. The supply air may for example be provided by a central Air handling Unit (AHU) (not shown) connected to the air terminal device via a ducting system. The pressure box 2 further comprises a multitude of outlet openings 4 located in an outlet surface 5 in the pressure box for delivering a flow of supply air (F) from the pressure box 2 to a mixing chamber 8. The outlet openings are located along a first edge 7*a* of the outlet surface 5 and a third edge 7*c*. The outlet surface 5 and the outlet openings 4, 4' along the first and third edge 7*a*, 7*c* will be shown in detail in FIG. 2. When the supply air flows into the mixing chamber 8 it will induce a flow I from the space where the air terminal unit 1 is located. The induced air flow I will flow via an air temperature conditioner 9, e.g. a heat exchanger having a liquid based heating media such as water for cooling or heating air passing through the heat exchanger. The induced flow I will mix with the supply air flow F in the mixing chamber 8 where after a mixed flow F+I will be admitted from the mixing chamber 8 via air terminal outlets 10 to the space to be ventilated. Hence, the air terminal device 1 in FIG. 1 is designed as a cooling beam or comfort cassette for heating or cooling of air to be admitted from the air terminal device 1 to a room.

Figure 1B:
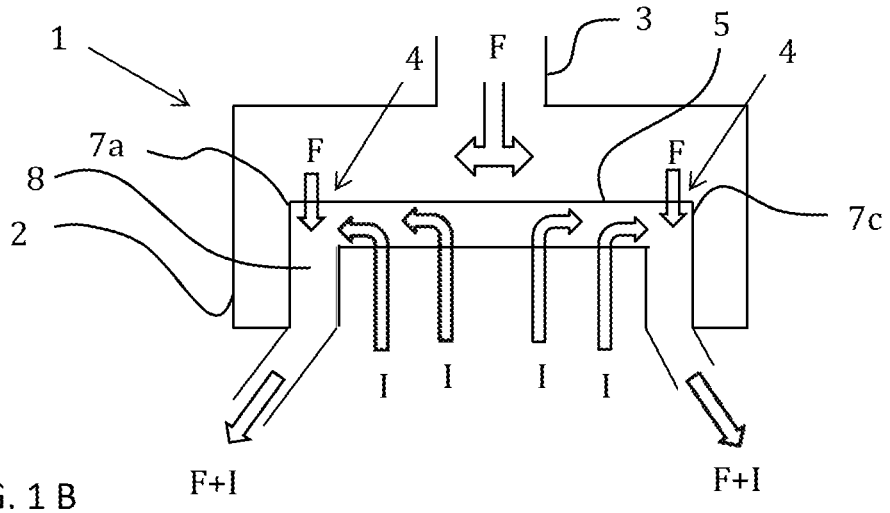

In FIG. 1*b* is disclosed a similar device but with the difference no air temperature conditioner 9 is included. Hence, this device works as an induction unit without any temperature conditioning. The induced air flow from the space to be ventilated will however help to improve the mixing of the air in the space and thus cause a better temperature profile in the room and reduce hot or cold streams arising from the air terminal device.

Figure 1C:
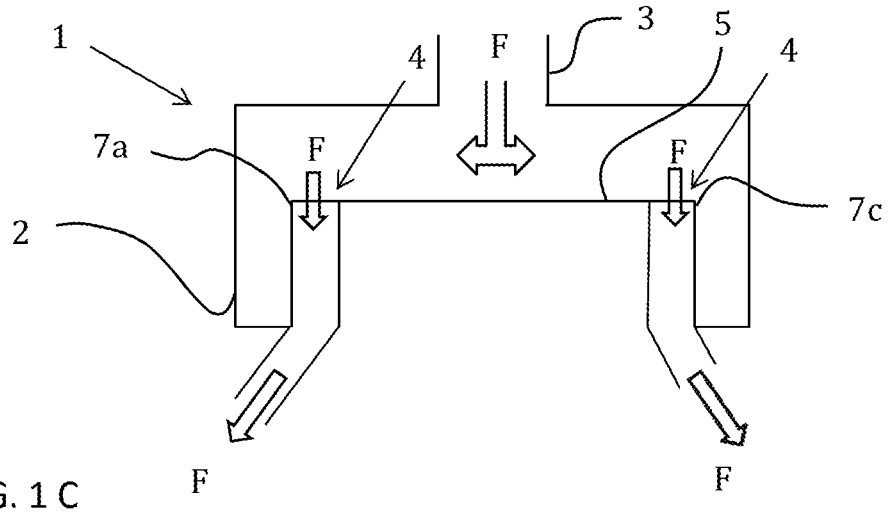

In FIG. 1*c* is disclosed still an alternative air terminal unit 1 without air temperature conditioner or induction arrangement and thus will function as an ordinary air diffuser providing air to a room.

Figure 2A:
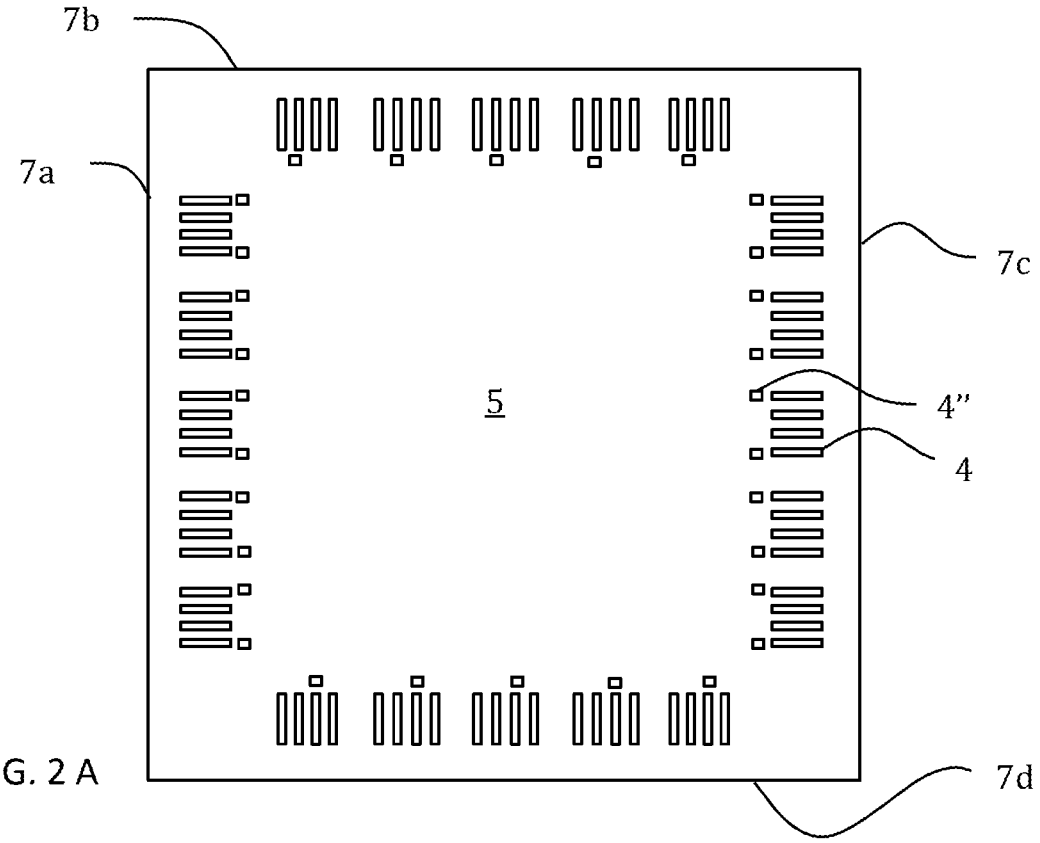
Figure 2B:
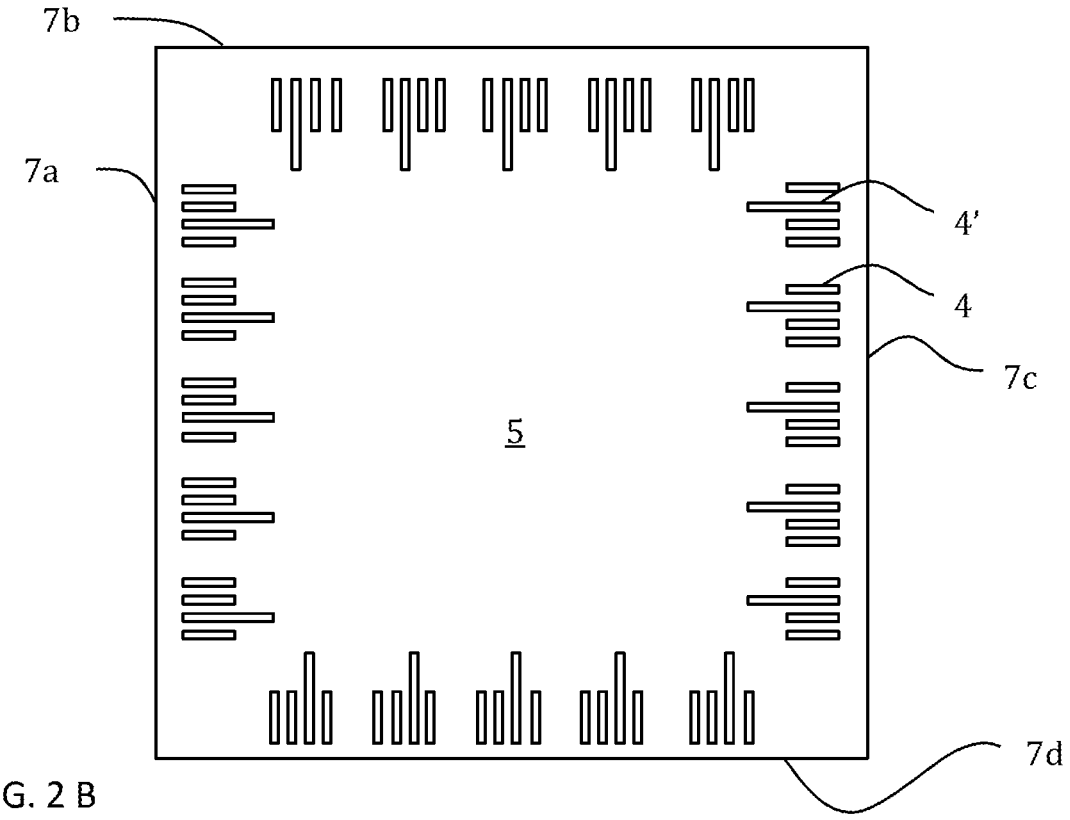

In FIG. 2A-B are disclosed two different configurations of outlet openings 4 in a square shaped outlet surfaces 5. In both FIG. 2*a* and FIG. 2*b* are there a multitude of outlet openings 4 along the first edge 7*a*, the second edge 7*b*, the third edge 7*c* and the fourth edge 7*d*. The outlet openings 4 are designed as elongated slits or slots having a longitudinal extension perpendicular to the extension of the edges 7*a-d* closest to the outlet openings.

The configurations in FIG. 2A and 2B differ in that in FIG. 2B are there some outlet openings 4' which are longer, and thus larger, than the ordinary outlet openings 4. However, in FIG. 2A are disclosed suction openings 4". The purpose of the outlet openings 4 in FIG. 2B and the suction openings in FIG. 2A are essentially the same. By the arrangement in FIG. 2B it is facilitated to have some outlet openings which are only partly open also when the cover plates (not shown, see FIG. 3) are set to maximum flow in order to keep the cover plate tight against the outlet surface 5 provided a cover plate is located on the high pressure side, i.e. inside the pressure box (see FIG. 1). In FIG. 2A, the suction openings 4" are arranged to cooperate with a cover plate such that the suction openings 4" are covered by cover plates (se arrangement in FIG. 3) in order to cause the cover plates to be positioned tight against the outlet surface 5 close to the outlet openings 4 when the cover plate is positioned to allow maximum flow. In general the suction openings 4" cooperate with one or several cover plates such that the suction openings are always covered by a cover plate. The suction openings 4" and the prolonged outlet openings 4' thus serves the purpose of keeping a cover plate tight against the outlet surface 5 due to the pressure difference over the wall of a pressure box comprising the outlet surface 5. In general, it is of particular interest to provide the attractive force striving to keep a cover plate, located on the high pressure side, tight against the outlet surface 5 in the vicinity of the outlet openings 4, 4' in order to avoid leakage, in particular when the cover plate is controlled to provide a high volume flow from the air terminal device 1. At high volume flows, there is normally only a small area of the outlet openings which are covered and thus contributes to force the cover plate to be positioned tight against the outlet surface. The outlet surfaces in FIGS. 2*a* and 2*b* could suitably be used for the air terminal devices in FIG. 1.

In FIG. 3 is disclosed an outlet surface 5 having basically the same design as the outlet surface in FIG. 2A with a number of prolonged outlet openings 4'. The device in FIG. 3 has been provided with a first cover plate 6*a* and a second cover plate 6*b*. The outlet surface 5 has further been provided with a first actuating rod 11 attached to the first cover plate 6*a* at its first end 11 a and attached to the second cover plate 6*b* at its second end 11*b* and having a pivotal point 11*c* at the middle of the first rod 11 being attached to the outlet surface 5. Furthermore, the outlet surface 5 has also been provided with a second actuating rod 12 attached to the first cover plate 6*a* at its first end 12*a* and attached to the second cover plate 6*b* at its second end 12*b* and having a pivotal point 12*c* attached at the centre of the first rod 11 to the outlet surface 5.

Figure 3A:
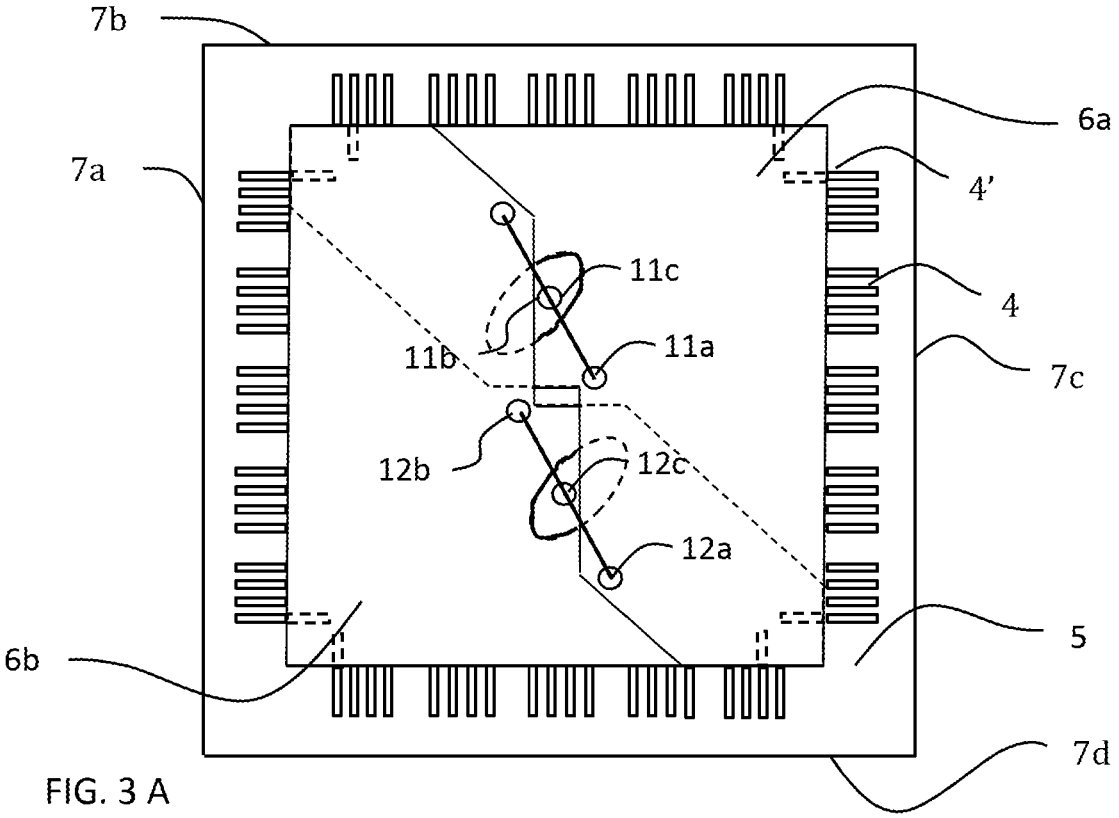

In FIG. 3A the cover plates 6*a*, 6*b* are controlled to be in an open position and thus keeping the ordinary outlet openings 4 completely open. In this position is thus intended that a maximum flow is allowed to flow through the outlet openings 4. However, the prolonged outlet openings 4' are partly covered by the cover plates 6*a*, 6*b* also when the cover plates 6*a*, 6*b* are set to maximum flow.

Figure 3B:
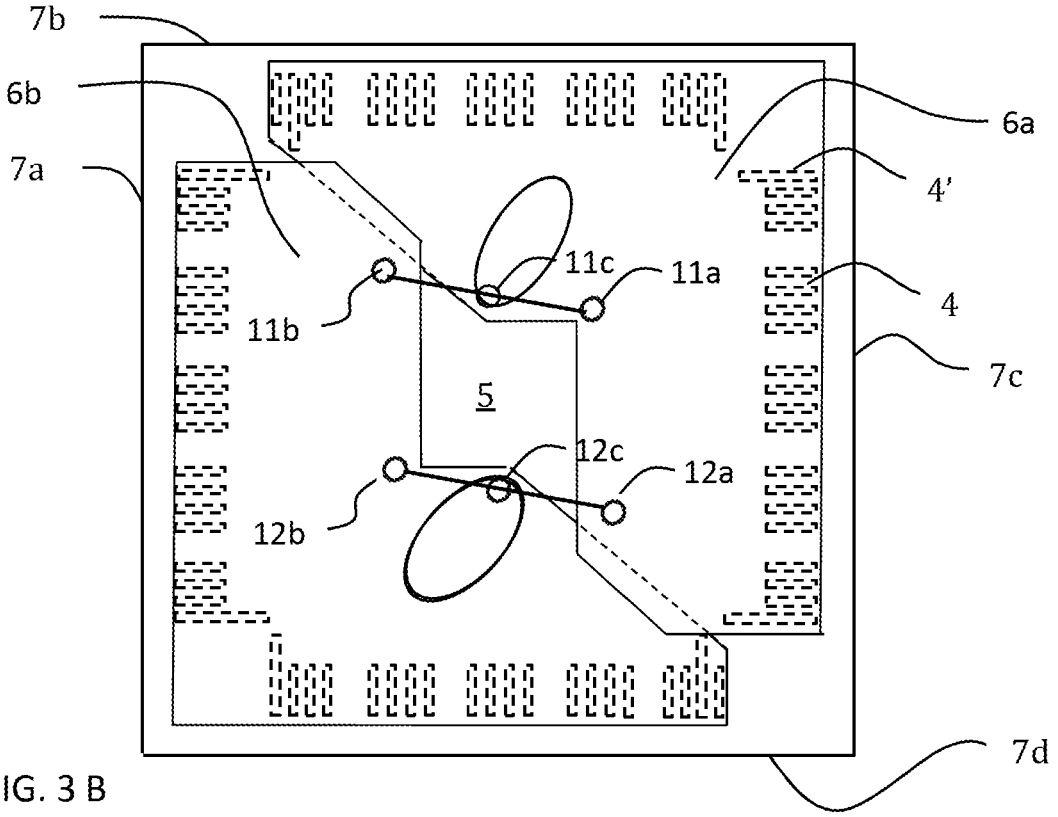

In FIG. 3B are the cover plates 6*a*, 6*b* controlled to be in a covering position and thus completely covering the ordinary outlet openings 4 as well as the prolonged outlet openings 4'. In this position is thus intended that no air should flow through the outlet openings 4, 4'.

The position in FIG. 3A is switched by turning the actuating rods 11, 12 about 40-50 degrees counter clockwise. The actuating rods 11, 12 will thus cause the cover plates 6*a*, 6*b* to move in different directions by a rotating movement. As can be understood by the positioning of the rods in FIG. 3A respectively FIG. 3B will the plates, when changing from the position in FIG. 3A to the position in FIG. 3B, first move more in the lateral direction, i.e. changing its distance relative the lateral edges 7*a*, 7*c* while at the end of the transition move increasingly in a straight direction, i.e. changing its distance relative the other edges 7*b*, 7*d*. However, by designing the rotational movement adequately it may be possible to provide an almost uniform motion. In order to return to from the closed position in FIG. 3B are the actuating rods 11, 12 turned back, clockwise, the same degrees (40 to 50 degrees). An actuator causing a rotational movement may thus be connected to either of the actuating rods 11, 12 in order to provide a rotation, e.g. to the first actuating rod. The other actuating rod, e.g. the second actuating rod, will thus be forced to turn around its pivotal point 12*c* due to its attachment to the cover plates 6*a*, 6*b* at its ends 12*a*, 12*b*. The second actuating rod 12 will functions as a guiding member in order to assure the cover plates 6*a*, 6*b* will move as desired.

Figure 4A:
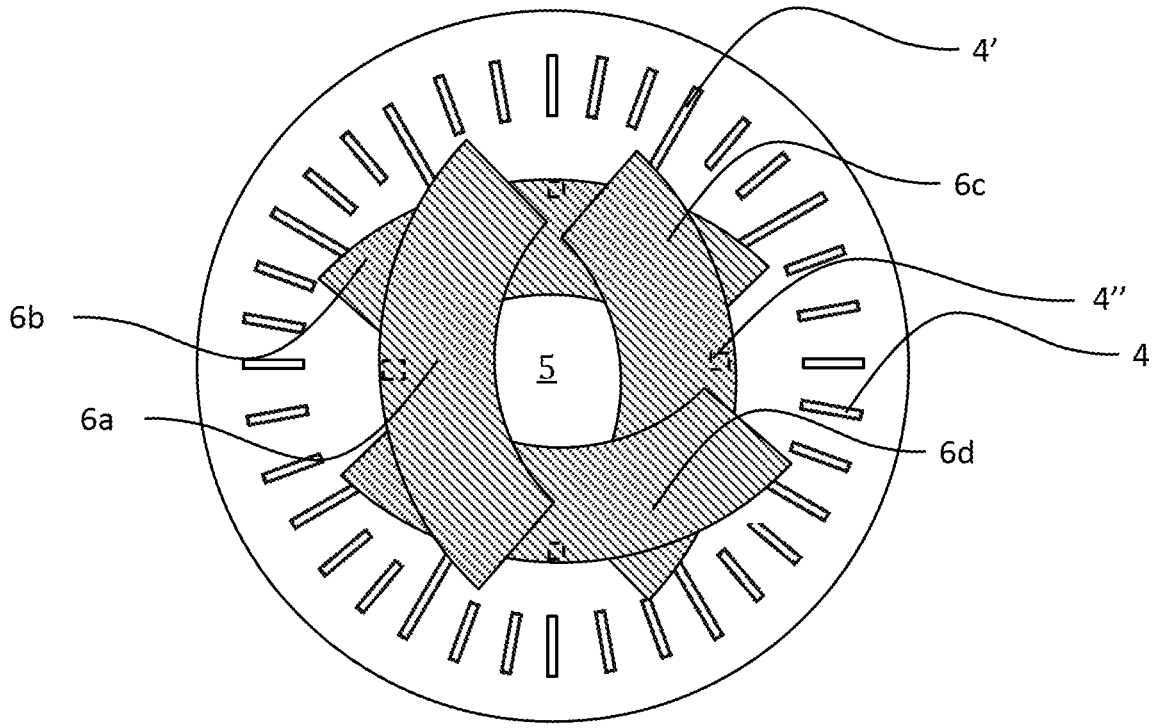

FIG. 4 only schematically discloses how the same principle as described with reference to FIGS. 2 and 3 may apply to a circular geometry. In this case, the outlet surface 5 has been provided with ordinary outlet openings 4 as well as prolonged outlet openings 4' and suction openings 4". As the outlet surface 5 is set to cooperate with the cover plates 6*a*, 6*b*, 6*c* 6*d* to provide maximum flow, which is disclosed in FIG. 4A, are the prolonged outlet openings 4' partly covered by the cover plates 6*a*, 6*b*, 6*c* 6*d* and the suction openings 4" are completely covered by the cover plates 6*a*, 6*b*, 6*c* 6*d*.

Figure 4B:
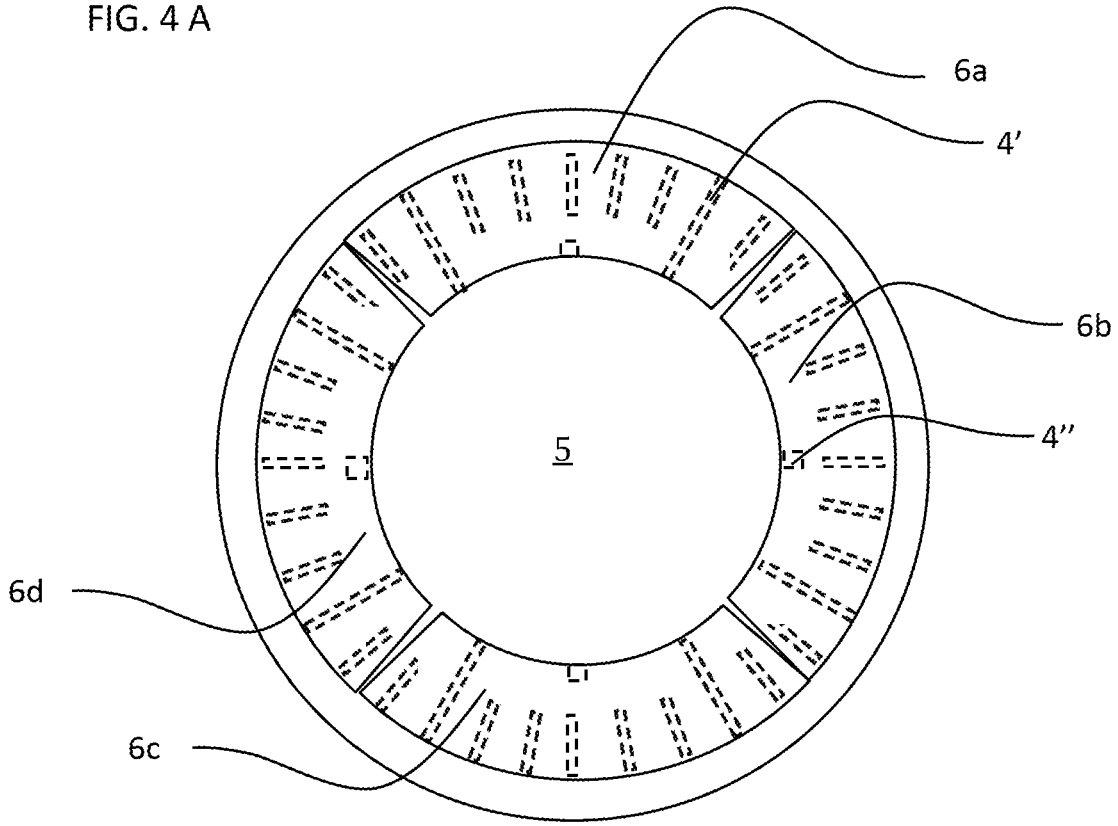

In FIG. 4B, the cover plates 6*a*, 6*b*, 6*c* 6*d* has rotated so as to completely cover all the outlet openings 4, 4' as well as the suction openings 4". To be noted, the cover plates 6*a*, 6*b*, 6*c* 6*d* have rotated clockwise one quarter turn while moving towards the edge of the outlet surface 5 such that the first cover plate 6*a*, being on the left side in FIG. 5A, has moved to be at the upper position, close to the edge of the outlet surface 5, in FIG. 4B.

Figure 5A:
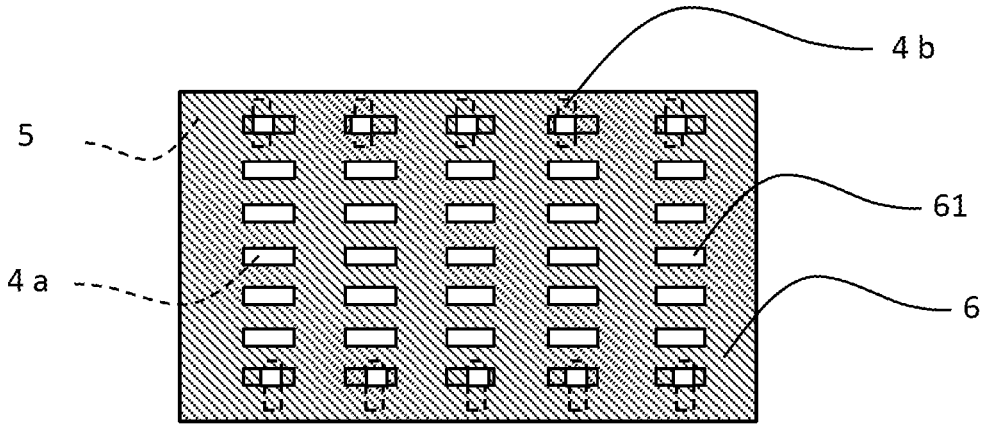
Figure 5B:
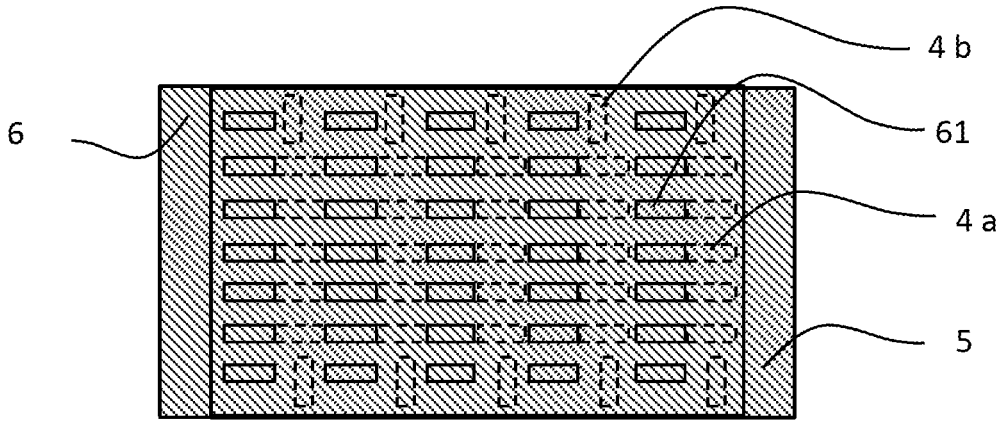

In FIG. 5 is disclosed still another embodiment of how an outlet surface 5 may be designed to cooperate with a cover plate 6. The outlet surface 5 is provided with outlet openings 4*a*, 4*b* in the shape of elongated slots being alternating designed to have an longitudinal extension either aligned with the linear direction of motion of the cover plate 6 (outlet openings denoted 4*a*) or being perpendicular to the linear motion of the cover plate (outlet openings denoted 4*b*). The perpendicular outlet openings 4*b* are designed to cooperate with cover plate openings 61 such that they are either forming a cross shaped partly overlapping position when the outlet surface 5 is set to cooperate with the cover plate 6 to provide maximum flow, as disclosed in FIG. 5A, wherein both ends of the perpendicular outlet openings 4*b* being covered at both ends by the cover plate 6 and thus will provide a force aiming to hold the cover plate 6 tight against the outlet surface 5. In this position, the aligned outlet openings 4*a* are arranged to cooperate with the cover plate openings 61 so as to completely overlap. In FIG. 5*b* is disclosed how the cover plate 6 has changed its position such that the cover plate 5 completely covers both the aligned outlet openings 4*a* as well as the perpendicular outlet openings 4*b* in order to completely shut of the flow of air through the outlet openings 4*a*, 4*b*.

The arrangements described in FIG. 5 could either be used at the edges of the outlet surfaces in FIGS. 2 and 3 using a linear movement of one or several cover plates. It would also be possible to cover essentially the complete plate of the outlet surfaces in FIGS. 2 and 3 with elongated slots being a mix of outlet openings being aligned, and adapted to completely overlap, with elongated cover plate openings and elongated cover plate openings being perpendicular to the longitudinal extension of the outlet openings in the outlet surface.

The same pattern of cover plate openings and outlet openings could also be applied to the circular device in FIG. 4. Similar basic principle, with elongated slots along the circular edge, could also suitable be used for the device in FIG. 4 but in that instance it would most probably be more suitable to use a rotational movement of the cover plate. In case there is a desire to have a precise overlap for the aligned cover plate openings and the outlet openings in the circular outlet surface for a rotational motion, the slots could be adapted to be arc shaped.

When cover plate openings are used to cooperate with outlet openings it may be possible to design the cover plate openings such that they are somewhat smaller than the outlet openings thus causing a portion of the cover plate always covering the outlet openings, e.g. having a multitude of elongated outlet openings being somewhat longer and/or wider than the cover plate openings.

In FIGS. 3 to 5, only the end positions are disclosed. The number of intermediate positions depends on the actuator; if the actuator is analogue there may be an endless number of intermediate positions thus allowing the cover plates 6, 6*a*, 6*b*, 6*c*, 6*d* to change the flow of air through the outlet surface by step less motion. In case the actuator is moved stepwise, it may have predefined positions with a known configuration of the coverage of the outlet openings such that an air flow may be calculated from these known positions and a pressure difference between the pressure box and the outside pressure.

The invention claimed is:

1. An air terminal device (1) for a ventilation system, including a Heating and Ventilation Air Conditioning (HVAC) system, for a building, said air terminal device (1) comprising:

a pressure box (2), provided with at least one inlet (3) for admitting supply air into the pressure box and a plurality of outlet openings (4) for admitting supply air out of the pressure box (2), and at least one cover plate (6, 6*a*, 6*b*, 6*c*, 6*d*) arranged to control and change an open area of a plurality of said outlet openings (4, 4*a*, 4*b*, 4'), wherein said plurality of outlet openings (4, 4*a*, 4*b*, 4') are arranged on an outlet surface (5) of the pressure box (2), wherein said at least one cover plate (6, 6*a*, 6*b*, 6*c*, 6*d*) is arranged to be in contact with and slide relative an outlet surface (5) while changing the open area of said outlet openings (4, 4*a*, 4*b*, 4'), wherein said at least one cover plate (6, 6*a*, 6*b*, 6*c*, 6*d*) is located on a high pressure side of the outlet surface (5) and there is at least one of said outlet openings (4, 4*a*, 4*b*, 4') being partly or fully covered by said at least one cover plate (6, 6*a*, 6*b*, 6*c*, 6*d*) also when the air terminal device (1) is set to maximum flow, and wherein one or several of the outlet openings (4') are designed to have a larger area than the majority of the outlet openings (4) such that a portion of the outlet openings (4') having a larger area are only partially covered when the air terminal device (1) is set to maximum flow.

2. The air terminal device (1) according to claim 1 wherein there are one or several suction openings (4") in the outlet surface (5) adjacent to the outlet openings (6*a*, 6*b*, 6*c*, 6*d*), said suction openings (4") being designed to cooperate with said cover plate (6*a*, 6*b*, 6*c*, 6*d*) such that said suction openings (4") are fully covered when the air terminal device (1) is set to maximum flow.

3. The air terminal device (1) according to claim 1 wherein, there are one or several suction openings (4") in the outlet surface (5) adjacent to the outlet openings (6*a*, 6*b*, 6*c*, 6*d*), said suction openings (4") being designed to cooperate with said cover plate (6*a*, 6*b*, 6*c*, 6*d*) such that said suction openings (4") are always fully covered by said cover plate (6*a*, 6*b*, 6*c*, 6*d*).

4. The air terminal device (1) according to claim 1 wherein said cover plate (6, 6*a*, 6*b*, 6*c*, 6*d*) is made of a thin sheet, having a thickness of 0.05 to 2.0 mm.

5. The air terminal device (1) according to claim 4 wherein said cover plate (6, 6*a*, 6*b*, 6*c*, 6*d*) is made of a flexible sheet having a Young's modulus of 1 000 to 20 000 MPa.

6. The air terminal device (1) according to claim 4 wherein said cover plate (6, 6*a*, 6*b*, 6*c*, 6*d*) is made of a polymer.

7. The air terminal device (1) according to claim 4 wherein said cover plate (6, 6*a*, 6*b*, 6*c*, 6*d*) is made of a flexible sheet having a Young's modulus of 1 500 to 15 000 MPa.

8. The air terminal device (1) according to claim 4 wherein said cover plate (6, 6*a*, 6*b*, 6*c*, 6*d*) is made of a flexible sheet having a Young's modulus between 2 000 and 10 000 MPa.

9. The air terminal device (1) according to claim 1 wherein said cover plate (6, 6*a*, 6*b*, 6*c*, 6*d*) has a surface weight of less than 1 kg per square meter.

10. The air terminal device (1) according to claim 1 wherein a first cover plate (6*a*) and a second cover plate (6*b*) are arranged to be in contact with and slide relative an outlet surface (5) while changing the open area of the outlet openings (4, 4').

11. The air terminal device (1) according to claim 10 wherein the first cover plate (6*a*) and the second cover plate (6*b*) are arranged to be in contact with and slide relative each other while changing the open area of the outlet openings (4, 4').

12. The air terminal device (1) according to claim 1 wherein said plurality of outlet openings (4, 4*a*, 4*b*, 4') are arranged along one or several edges (7, 7*a*, 7*b*, 7*c*, 7*d*) of the outlet surface (5).

13. The air terminal device (1) according to claim 1, wherein the open area of the outlet openings (4, 4') are changed to be smaller by moving the cover plate (6*a*, 6*b*, 6*c*, 6*d*) towards the edge or edges (7, 7*a*, 7*b*, 7*c*, 7*d*) of the outlet surface (5) along which the outlet openings (4, 4') are located.

14. The air terminal device (1) according to claim 1 wherein said plurality of outlet openings (4, 4*a*, 4*b*, 4') are shaped as elongated slits.

15. The air terminal device (1) according to claim 1 wherein the outlet openings (4, 4*a*, 4*b*, 4') are directed to a mixing chamber (8) where to a stream of air from the space to be ventilated is induced by the flow of the supply air through the outlet openings (4, 4*a*, 4*b*, 4') such that the stream of supply air is mixed with room air.

16. The air terminal device (1) according to claim 1 wherein the air terminal (1) device is provided with an air temperature regulating device (9) in order to condition the air flowing through the air terminal device.

17. The air terminal device (1) according to claim 1 wherein said cover plate (6, 6*a*, 6*b*, 6*c*, 6*d*) is made of a thin sheet having a thickness between 0.10 and 1.0 mm.

18. The air terminal device (1) according to claim 1 wherein said cover plate (6, 6*a*, 6*b*, 6*c*, 6*d*) is made of a thin sheet having a thickness of 0.1 to 0.6 mm.

19. The air terminal device (1) according to claim 1 wherein said cover plate (6, 6*a*, 6*b*, 6*c*, 6*d*) has a surface weight of less than 0.5 kg per square meter.

* * * * *